US009138377B1

(12) United States Patent
Boone et al.

(10) Patent No.: US 9,138,377 B1
(45) Date of Patent: Sep. 22, 2015

(54) RECOGNITION AND UTILIZATION OF PRODUCT RELATED INFORMATION BY SURPRISE PRESENTATION

(71) Applicants: Mike Boone, Laguna Beach, CA (US); Kyle Schroeder, Laguna Beach, CA (US)

(72) Inventors: Mike Boone, Laguna Beach, CA (US); Kyle Schroeder, Laguna Beach, CA (US)

( * ) Notice: Subject to any disclaimer, the term of this patent is extended or adjusted under 35 U.S.C. 154(b) by 274 days.

(21) Appl. No.: 13/911,941

(22) Filed: Jun. 6, 2013

(51) Int. Cl.
*B65D 85/14* (2006.01)
*A61J 1/00* (2006.01)
*B65D 77/00* (2006.01)

(52) U.S. Cl.
CPC . *A61J 1/00* (2013.01); *B65D 77/00* (2013.01); *B65D 2203/00* (2013.01)

(58) Field of Classification Search
CPC ..... B65D 77/00; B65D 2203/00
USPC ..... 206/232, 277, 459.5; 40/310; 215/230, 215/386
See application file for complete search history.

(56) References Cited

U.S. PATENT DOCUMENTS 1,353,531 A * 9/1920 Heard ..... 40/310
2,177,359 A * 10/1939 Baker ..... 215/386
2,625,131 A * 1/1953 Sturhahn ..... 215/386
3,256,978 A * 6/1966 Srigley et al. ..... 206/232
5,555,655 A * 9/1996 Yager et al. ..... 40/306
5,826,356 A 10/1998 Lapp
5,860,387 A * 1/1999 Giveen ..... 206/277
6,321,473 B1 * 11/2001 Klabunde ..... 40/310
D676,572 S 2/2013 Tarriff
2006/0283059 A1 * 12/2006 Cope et al. ..... 40/310
2010/0006587 A1 1/2010 Newmark

FOREIGN PATENT DOCUMENTS

JP 2000355311 A 12/2000
JP 2010274951 A 12/2010
JP 4847381 B2 12/2011

* cited by examiner

*Primary Examiner* — Luan K Bui
(74) *Attorney, Agent, or Firm* — Patent Law & Venture Group; Gene Scott

(57) ABSTRACT

A container neck supports a disc which presents an information. The disc is not visible until a container cap is removed. The information may have a warning which is critical to the use of the container or its contents. Because the information is presented as a surprise to the user who removes the cap, the user is more likely to take notice and therefore heed what the information presents. Such understanding by the user may be critical to the successful use of the contents and may prevent a dangerous situation from arising such as ingesting an improper medication. It has been shown through statistical testing that a user is more likely to take heed of a hidden message visible only upon removal of the cap, than a similar message presented on a disc or other label that is visible prior to removal of the cap.

11 Claims, 4 Drawing Sheets

RECOGNITION AND UTILIZATION OF PRODUCT RELATED INFORMATION BY SURPRISE PRESENTATION

BACKGROUND

The prior art teaches the use of a label placed around the neck of a container of a consumer product for intended purposes such as advertising, promotion, container sealing, contents identification, and directions for use. Such labels are visible to a user when taken off a store shelf and when purchased. The prior art is universal in this respect because the manufacturer or distributor of the product generally wishes the consumer to see the label which is to mutual advantage. Containers also universally have contents information and use-instructions printed on labels affixed to their exterior surfaces. However, although such affixed instructions may be critical to the successful use of a product, as for instance with medications, often labels are not read or may be improperly understood and followed, and this can be harmful; or even life-threatening in unusual circumstances. Therefore, a need exists for improving the impact of a presentation of product information, warnings, cautions and so forth to gain the maximum attention of a consumer or other product user at the point of use where the user is most subject to accepting and understanding important directions. The apparatus of this disclosure overcomes the above problems and has further advantages as described in the following detailed description and related drawing figures.

BRIEF SUMMARY AND OBJECTIVES

The present disclosure describes a novel and non-obvious information disc label and container combination. The disc and its information is not visible to a user prior to removal of a cap on a neck of the container. Upon removing the cap the fact that an information exists becomes boldly evident and the expression of the information is thrust at the user by surprise. This has been shown to have advantage over prior art labels including those attached to or around the neck of containers and bottles. The objectives of the presently described apparatus include the presentation, as a complete surprise, of information directed to a user just prior to possibly unsealing a container or using its ingredients. A further objective is to prevent a user from detecting the presence of the information prior to the point of use, that is, the moments just prior to opening and using a product container. A further objective is to provide on operant connection between the use or dispensing of a product and the information necessary to use the product safely or in accordance with prescribed methods especially in critical situations.

BRIEF DESCRIPTION OF THE SEVERAL VIEWS OF THE DRAWINGS

Like reference symbols in the various drawings indicate like elements.

DETAILED DESCRIPTION

Figure 1:
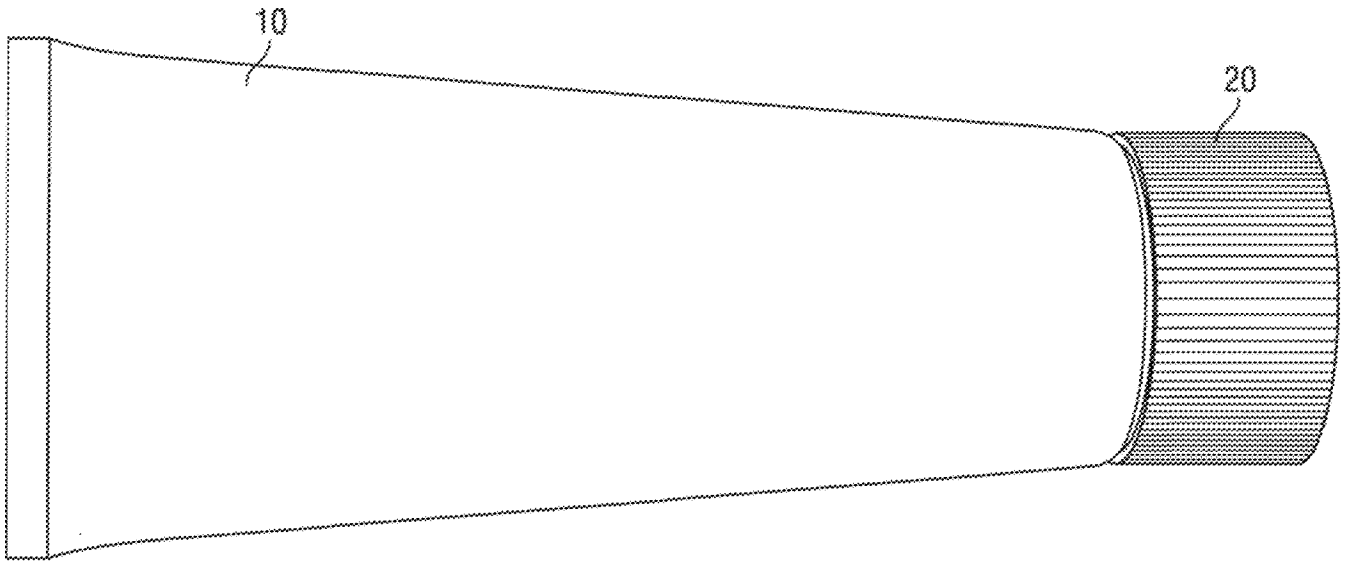
FIG. 1 is an example plan view of an embodiment of the presently described and claimed apparatus, a squeeze tube with cap.

Referring now to the drawing figures and as described below, the presented apparatus includes a container 10 with a dispensing neck 12 closed by a removable cap 20. In FIG. 1, container 10 is shown as a squeeze tube such as those that may be used for shaving cream, toothpaste, suntan lotion and other semisolid products. However, container 10 is exemplary of any container or bottle including those for dispensing solid materials such as: medicinals, candy, food stuffs and cooking ingredients to mention only a few and such containers may take alternative forms. Clearly container 10 may also be used for dispensing liquids such as: mouthwash, drinks, window cleaning spray, and cooking oil, again, to mention only a few and such containers my take alternative forms as well. Container 10, in some of its possible forms may be used for dispensing dangerous and even deadly materials or substances.

Figure 2:
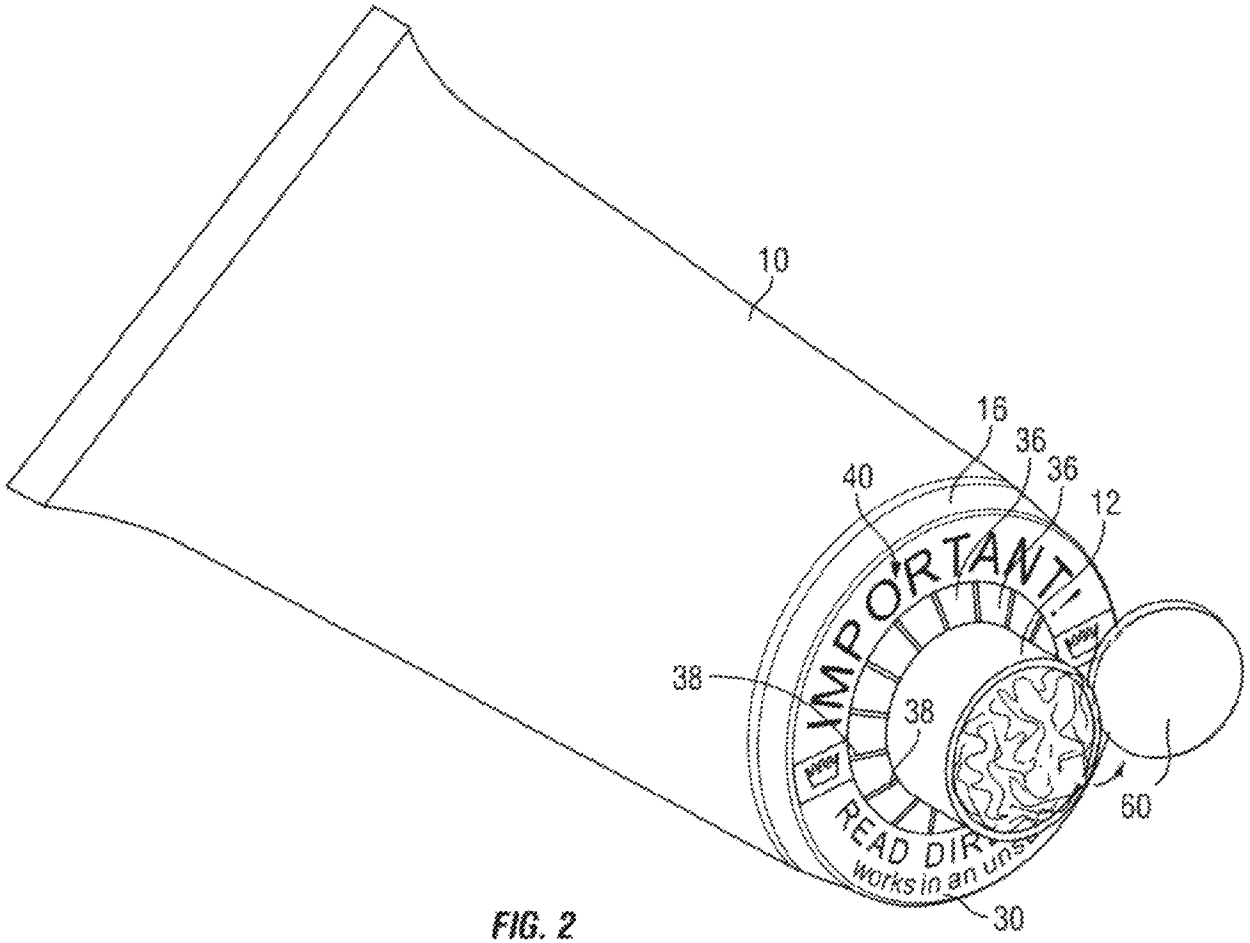
FIG. 2 is an example perspective view thereof with the cap removed revealing a disc label engaged with a neck of the tube and showing a sealing foil as partially removed.

As shown in FIG. 1, with cap 20 in place on neck 12, an information disk 30 (refer to FIG. 2, is not visible. Therefore, as shown in FIG. 2, prior to removing cap 20 there is no expectation of being confronted with information disk 30. The presentation of hidden information disk 30, being a complete surprise, causes the person to take notice of its message in a more attentive manner than would otherwise be expected. This was confirmed by testing subjects. Subjects were told that they were testing a skin crème. In a first subject group each subject was given a container as shown in FIG. 1 but with disk 30 extending out from under cap 20 by about half-an-inch all around, i.e., clearly visible prior to removing cap 20. In a second subject group the same product was used but with the disk 30 hidden under cap 20 as shown in FIGS. 1 and 2. In both cases, the subjects removed the caps 20 and tested the cream. A short time later, each of the subjects filled out a questionnaire with questions about how they liked the cream. There was also a question asking the subjects if there was a written message on the disk 30 and also to write down what was printed on disk 30 (see FIG. 3). Results of these tests on a statistically random and normal subject population showed that the second group consistently had a statistically significant improvement over the first group in remembering that there was a written message on the information disk 30 and also remembering more of what the message included. The conclusion of this testing is that hiding the message disk 30 under the cap 20 clearly improves the impact and therefore the improved reading and understanding of its information 40.

Figure 4:
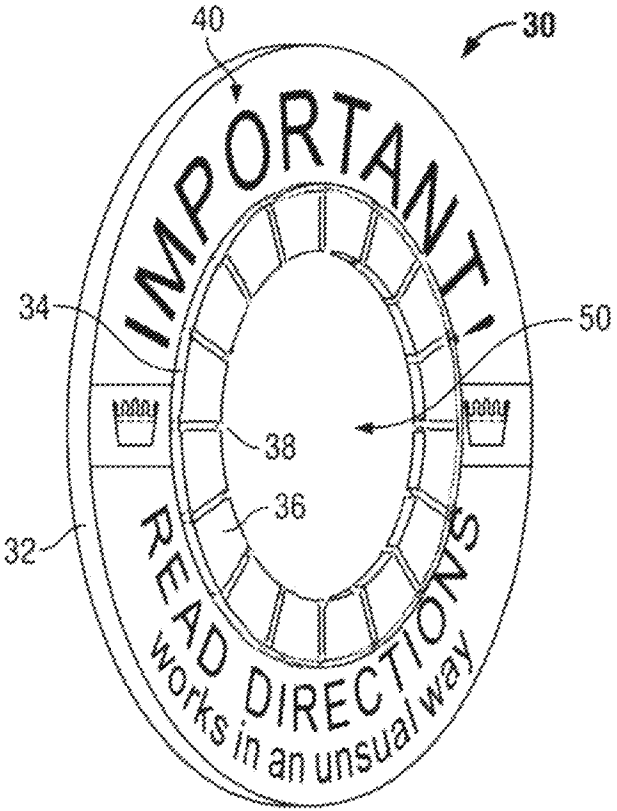
FIG. 4 is an example perspective view of the label.
Figure 3:
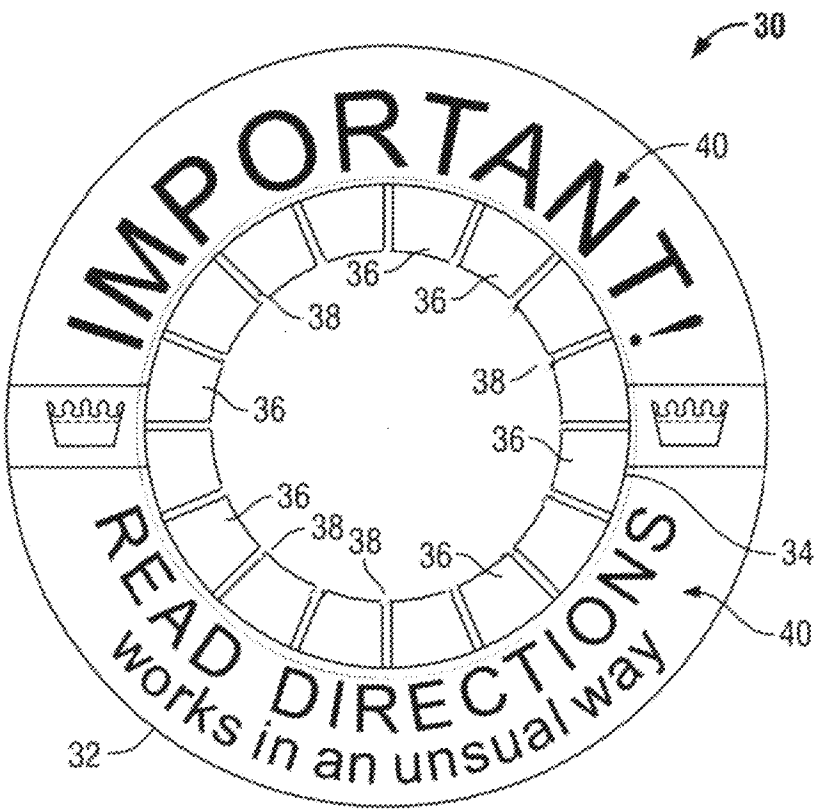
FIG. 3 is an example plan view of the label.

As shown in FIG. 3, disk 30 may be circular and as shown in FIG. 4, it may be made of a relatively thin material such as paper, cardboard, or plastic among other possibilities. Disk 30 may be other than round, as it may be square, trapezoidal, or any other non-round shape. Disk 30 may be rigid or flexible and may have a thickness ranging from that of letter paper, a few thousandths of an inch, to the thickness of a U.S. quarter-dollar coin or even thicker. Disk 30 may carry the information 40 on one or both of its sides and such information 40 may be placed by printing, inscribing, hot press transfer, screening, or in any other manner. Information 40 may include colors, graphic designs, written text, and any other cognitive matter. The relationship between container 10, neck 12 and cap 20, with respect to label 30 is critical to the achievement of the above described objectives of the apparatus as will be discussed further below.

As best shown in FIG. 3, disk 30 may have a circular crease 34, tabs 36 arranged in a circular array, and slits 38 separating adjacent tabs 36. When disk 30 is placed on neck 12 tabs 38 hinge about crease 34 allowing disk 30 to be forced into position "A" shown in FIGS. 5 and 6 whereupon tabs 38 may resume an attitude that is planar with the general form of disk 30. With disk 30 in position "A" it is captured on neck 12 and remains in place even when cap 20 is removed. This is essential for meeting the objectives stated above.

FIG. 3 clearly shows the nature and a possible layout of an indicia that may be presented by disk 30. Clearly, there is are endless possibilities for colors, font, locations, arrangements and the nature of readable messages that may be applied to the outwardly presented surface of disk 30. Such indicia may include, as for only a few examples: "STOP! POSION!!," "INGREDIENTS VOLITILE," "CAUTION, CONTENTS BURN IN AIR," and "IMPORTANT! READ DIRECTIONS WORKS IN AN UNUSUAL WAY." In FIG. 2, neck 12 is shown having a foil seal 60 which must be removed in order to admit air into container 10 or to dispense its contents as is well known.

Figure 5:
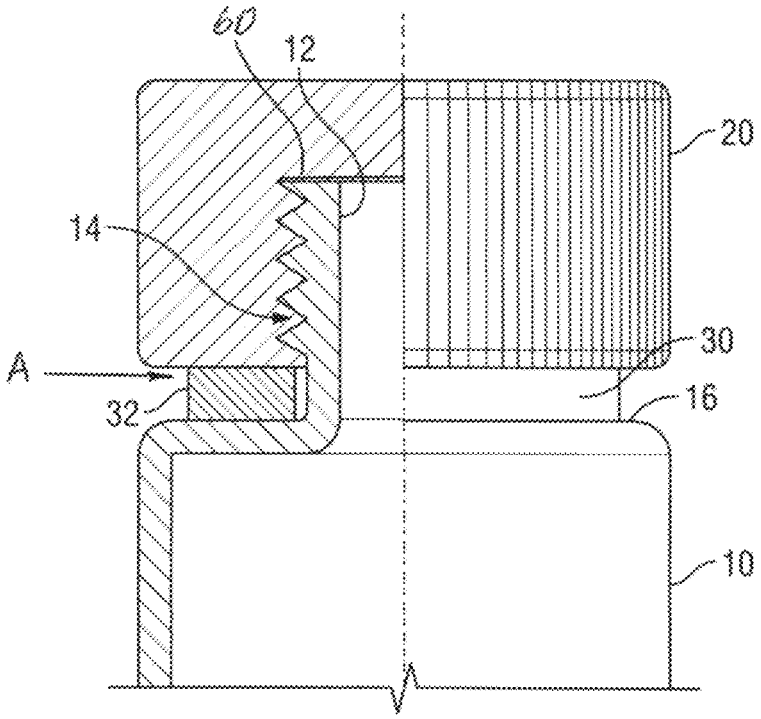
FIG. 5 is an example vertical half-section, truncated view of the apparatus showing one embodiment thereof.
Figure 6:
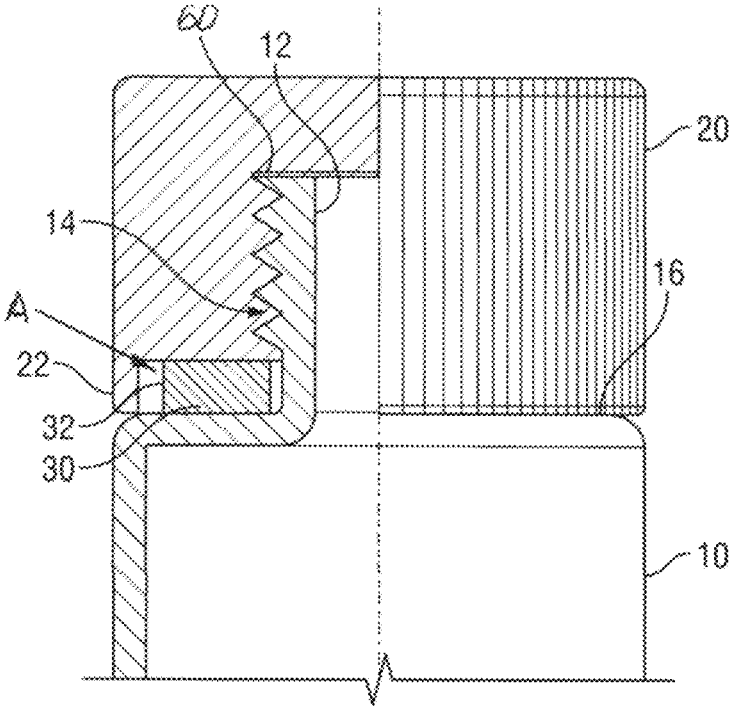
FIG. 6 is an example vertical half-section, truncated view thereof showing a further embodiment of the apparatus.

Referring now to FIG. 5, in one embodiment, disc 30 may be clamped between cap 20 and shoulder 16 of container 10. The outer circumference 32 of disk 20 is smaller in diameter than the outside dimension of cap 20 so that it is not apparent that disc 30 is present until cap 20 is removed. In the embodiment shown in FIG. 6, cap 20 is shown to have an outer peripheral flange 22 which prevents visual discovery of disc 30 prior to removal of cap 20.

We know that the apparatus described herein holds a material contents, which may be solid, semisolid, or liquid. As a fluid, the contents may also be a vapor or a gas. Two critical factors are evident here; the first is that the opening of container 10, i.e., removal of foil seal 60 or similar step, may be dangerous in itself as it may release a poison or other unacceptable substance into the immediate atmosphere, or it may cause degradation of the contained substance within container 10 by species present in the ambient atmosphere, as for instance oxygen or nitrogen or other components present as partial pressures in air or introduced in a closed area such as a laboratory. The second is that the contents, upon being dispensed from container 10, may be misused causing a dangerous situation. It may be extremely critical to assure that the user understands how or when to open container 10, and how to utilize its contents.

The indicia 40 has an operant relationship with the material contents within, or the use of, container 10. For instance such an operant relationship may be a known danger in the use of the material contents and a warning message in the indicia 40 directed to the use danger. The operant relationship may also be a known and necessary prescribed use of the material contents and a use message in the indicia 40 directed to the prescribed use of the material contents. Finally, the operant relationship may be an important procedure in opening the container and a warning message in the indicia 40 directed to a danger in the opening of the container.

Embodiments of the subject apparatus and method of use have been described herein. Nevertheless, it will be understood that various modifications may be made without departing from the spirit and understanding of this disclosure. Accordingly, other embodiments and approaches are within the scope of the following claims.

What is claimed is:

1. An apparatus comprising:

a container having a body including a shoulder, and integral with the shoulder, a neck having an outside surface configured with a first engagement;

a disc having an outside circumference and a hole, the neck extensive within the hole;

a cap having an exterior surface and an interior space, the interior space having a second engagement, the second engagement enabled for gripping the first engagement for securing the cap to the neck; and the cap has a peripheral flange surrounding the disc when the cap and the disc are engaged with the neck;

a face of the disc is covered by the peripheral flange of the cap when the disc and the cap are engaged with the neck, whereby the face of the disc is only visible when the cap is removed from the neck of the container.

2. The apparatus of claim 1 wherein the face of the disc has information thereon, said information including at least one of: a color, a text, and a graphic image.

3. The apparatus of claim 2, wherein the container holds a substance therein, the information having a relationship with the substance.

4. The apparatus of claim 1, wherein when the first and second engagements are mutually joined, the cap is secured on the neck of the container.

5. The apparatus of claim 4, wherein the cap is secured on the neck of the container by at least one of: friction, screw threads, locking elements, and splines.

6. An apparatus comprising:

a container holding a material contents, the container having an integral neck and a removable cap, the removable cap engaged with the integral neck;

an information disc secured on the integral neck;

wherein the removable cap has a size and shape and wherein said size and shape of said removable cap obscures an indicia on the information disc; and wherein the indicia is visible upon removal of the removable cap from the integral neck; and wherein the indicia has an operant relationship with the material contents or the use of the container.

7. The apparatus of claim 6 wherein the operant relationship between the material contents and the indicia is a known danger in the use of the material contents and a warning message in the indicia directed to the danger in the use of the material contents.

8. The apparatus of claim 6 wherein the operant relationship between the material contents and the indicia is a prescribed use of the material contents and a use message in the indicia directed to the prescribed use of the material contents.

9. The apparatus of claim 6 wherein the operant relationship between the use of the container and the indicia is an important procedure in opening the container and a warning message in the indicia directed to a danger in the opening of the container.

10. The apparatus of claim 6 wherein the indicia includes at least one of: a color, a text, and a graphic image.

11. The apparatus of claim 6, wherein the cap is secured on the neck of the container by one of mutual friction, screw thread engagement, and an interference fit.

* * * * *